US011561487B2

(12) United States Patent
Mochizuki

(10) Patent No.: US 11,561,487 B2
(45) Date of Patent: Jan. 24, 2023

(54) IMAGE FORMING APPARATUS FOR REGULATING REMOVAL OF DEVELOPER STORAGE PORTION, REGULATION METHOD

(71) Applicant: KYOCERA Document Solutions Inc., Osaka (JP)

(72) Inventor: Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/452,383

(22) Filed: Oct. 26, 2021

(65) Prior Publication Data

US 2022/0137534 A1 May 5, 2022

(30) Foreign Application Priority Data

Oct. 30, 2020 (JP) ..... JP2020-182423

(51) Int. Cl.
*G03G 15/08* (2006.01)
*G03G 21/18* (2006.01)

(52) U.S. Cl.
CPC ..... *G03G 15/0879* (2013.01); *G03G 15/0812* (2013.01); *G03G 21/1839* (2013.01)

(58) Field of Classification Search
CPC ..... G03G 15/556; G03G 15/0877; G03G 15/0856; G03G 15/0879; G03G 15/5016; G03G 21/1633
See application file for complete search history.

(56) References Cited

U.S. PATENT DOCUMENTS

2012/0243885 A1* 9/2012 Mitsui ..... G03G 15/0863 399/27
2019/0265612 A1* 8/2019 Ishida ..... G03G 15/0851
2019/0302686 A1* 10/2019 Mochizuki ..... G03G 21/1839
2019/0317444 A1* 10/2019 Nagaya ..... G03G 15/556

FOREIGN PATENT DOCUMENTS

JP 2017198909 A 11/2017

* cited by examiner

*Primary Examiner* — Jessica L Eley
(74) *Attorney, Agent, or Firm* — Alleman Hall Creasman & Tuttle LLP

(57) ABSTRACT

An image forming apparatus includes a release processing portion, a regulation processing portion, and a second restriction processing portion. The release processing portion releases regulation on removal of a developer storage portion when a storage amount of developer stored in an image forming portion is equal to or smaller than a second threshold smaller than a first threshold. The regulation processing portion regulates removal of the developer storage portion when the storage amount of the developer stored in the image forming portion is larger than the second threshold and removal of the developer storage portion has not been regulated. The second restriction processing portion imposes restriction on processing of the regulation processing portion when the regulation on the removal of the developer storage portion is released and a restriction condition is satisfied.

10 Claims, 12 Drawing Sheets

IMAGE FORMING APPARATUS FOR REGULATING REMOVAL OF DEVELOPER STORAGE PORTION, REGULATION METHOD

INCORPORATION BY REFERENCE

This application is based upon and claims the benefit of priority from the corresponding Japanese Patent Application No. 2020-182423 filed on Oct. 30, 2020, the entire contents of which are incorporated herein by reference.

BACKGROUND

The present disclosure relates to an image forming apparatus and a regulation method that is executed in an image forming apparatus.

There is known an image forming apparatus that is configured to regulate removal of a developer storage portion, such as a toner container, from an attachment portion to which the developer storage portion is attached.

For example, in the image forming apparatus, in a case where an amount of developer stored in a developing portion that develops an electrostatic latent image by using the developer is equal to or smaller than a predetermined first threshold, the developer is supplied to the developing portion from the developer storage portion attached to the attachment portion. In addition, in a case where the amount of developer stored in the developing portion is equal to or smaller than a second threshold that is smaller than the first threshold, a regulation on the removal of the developer storage portion is released. With this configuration, as compared with a configuration where the developer storage portion can be replaced at an arbitrary timing, it is possible to reduce the remaining amount of developer in the developer storage portion at the time of a replacement of the developer storage portion.

In addition, in the image forming apparatus, in a case where the storage amount of the developer in the developing portion is larger than the second threshold, and the removal of the developer storage portion has not been regulated, the removal of the developer storage portion is regulated. With this configuration, in a case where the amount of developer stored in the developing portion temporarily becomes equal to or smaller than the second threshold due to low liquidity of the developer in the developer storage portion, it is possible to inhibit the replacement of the developer storage portion.

SUMMARY

An image forming apparatus according to an aspect of the present disclosure includes an attachment portion, a regulation portion, an image forming portion, a supply processing portion, a release processing portion, a first restriction processing portion, a regulation processing portion, and a second restriction processing portion. A developer storage portion storing developer is attached to the attachment portion. The regulation portion regulates removal of the developer storage portion attached to the attachment portion from the attachment portion. The image forming portion includes a storage portion storing the developer and forms an image by using the developer stored in the storage portion. The supply processing portion supplies the developer from the developer storage portion attached to the attachment portion to the storage portion when a storage amount of the developer stored in the storage portion is equal to or smaller than a predetermined first threshold. The release processing portion releases regulation on the removal of the developer storage portion imposed by the regulation portion when the storage amount of the developer stored in the storage portion is equal to or smaller than a second threshold that is smaller than the first threshold. The first restriction processing portion imposes restriction on operation of the image forming portion when the storage amount of the developer stored in the storage portion is equal to or smaller than a third threshold that is smaller than the second threshold. The regulation processing portion causes the regulation portion to regulate the removal of the developer storage portion when the storage amount of the developer stored in the storage portion is larger than the second threshold and the removal of the developer storage portion has not been regulated by the regulation portion. The second restriction processing portion imposes restriction on processing of the regulation processing portion when the release processing portion releases the regulation on the removal of the developer storage portion and a predetermined restriction condition is satisfied.

A regulation method according to another aspect of the present disclosure is executed in an image forming apparatus that includes an attachment portion to which a developer storage portion storing developer is attached, a regulation portion configured to regulate removal of the developer storage portion attached to the attachment portion from the attachment portion, and an image forming portion including a storage portion storing the developer and configured to form an image by using the developer stored in the storage portion, the regulation method including a supply step, a release step, a first restriction step, a regulation step, and a second restriction step. In the supply step, the developer is supplied from the developer storage portion attached to the attachment portion to the storage portion when a storage amount of the developer stored in the storage portion is equal to or smaller than a predetermined first threshold. In the release step, regulation on the removal of the developer storage portion imposed by the regulation portion is released when the storage amount of the developer stored in the storage portion is equal to or smaller than a second threshold that is smaller than the first threshold. In the first restriction step, restriction is imposed on operation of the image forming portion when the storage amount of the developer stored in the storage portion is equal to or smaller than a third threshold that is smaller than the second threshold. In the regulation step, the regulation portion is caused to regulate the removal of the developer storage portion when the storage amount of the developer stored in the storage portion is larger than the second threshold and the removal of the developer storage portion has not been regulated by the regulation portion. In the second restriction step, restriction is imposed on processing of the regulation step when the release step releases the regulation on the removal of the developer storage portion and a predetermined restriction condition is satisfied.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

First, a configuration of an image forming apparatus 100 according to an embodiment of the present disclosure is described with reference to FIG. 1 and FIG. 2. FIG. 2 is a perspective diagram showing an outer appearance of the image forming apparatus 100. It is noted that FIG. 2 shows the image forming apparatus 100 in a state where an ADF 1 is removed therefrom.

For convenience of the explanation, the vertical direction in an installation state where the image forming apparatus 100 is installed in a usable manner (the state shown in FIG. 2) is defined as an up-down direction D1. In addition, a front-rear direction D2 is defined on the supposition that a front right surface of the image forming apparatus 100 shown in FIG. 2 is a front (front surface). In addition, a left-right direction D3 is defined with reference to the front of the image forming apparatus 100 in the installation state.

The image forming apparatus 100 is a multifunction peripheral having a plurality of functions such as a scan function to read an image of a document sheet, a print function to form an image based on image data, a facsimile function, and a copy function. It is noted that the image forming apparatus 100 may be a printer, a facsimile apparatus, or a copier.

Figure 1:
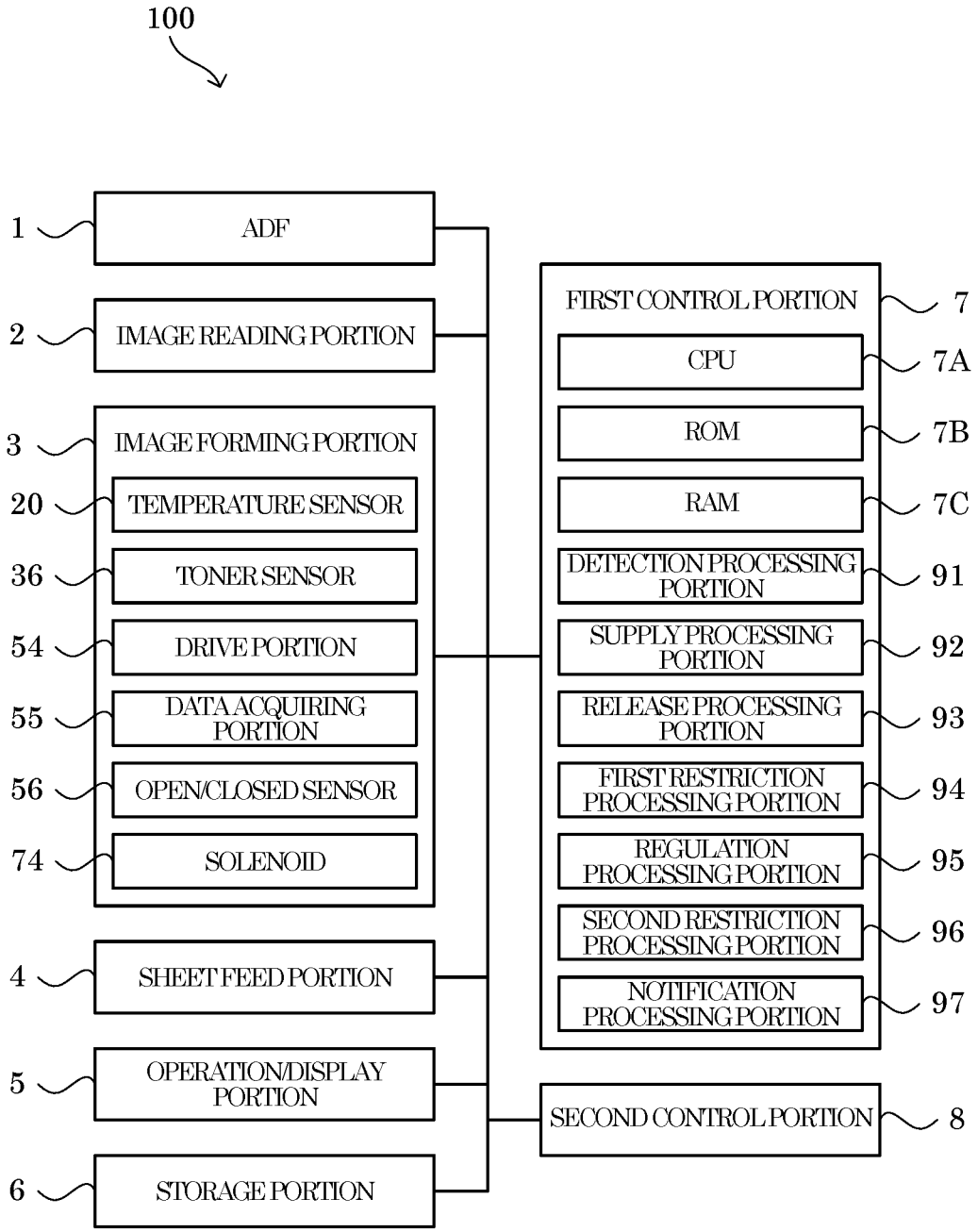
FIG. 1 is a block diagram showing a system configuration of an image forming apparatus according to an embodiment of the present disclosure.
Figure 2:
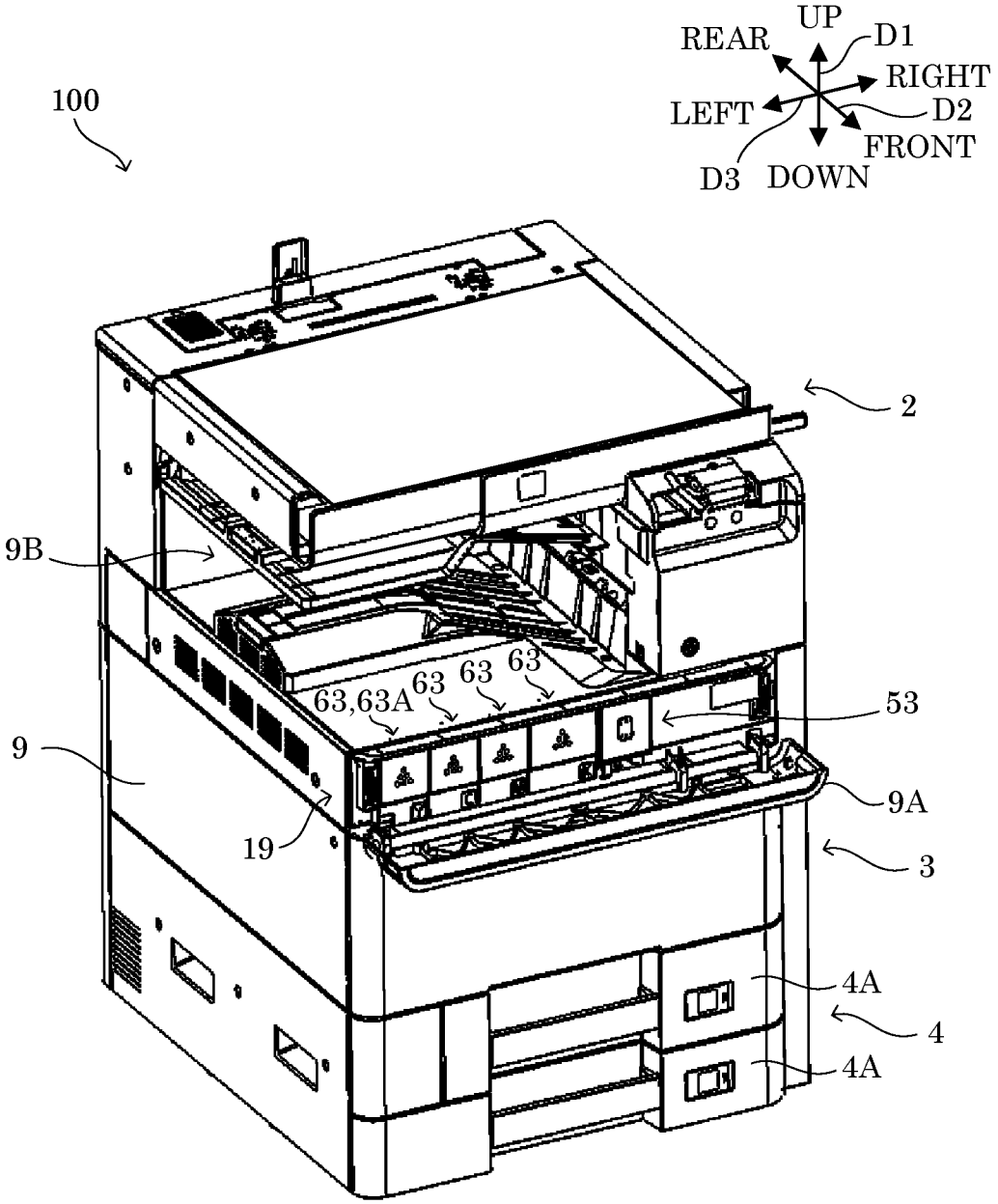
FIG. 2 is a diagram showing an outer appearance of the image forming apparatus according to the embodiment of the present disclosure.

As shown in FIG. 1 and FIG. 2, the image forming apparatus 100 includes the ADF (Auto Document Feeder) 1, an image reading portion 2, an image forming portion 3, a sheet feed portion 4, an operation/display portion 5, a storage portion 6, a first control portion 7, a second control portion 8, and a housing 9.

The ADF 1 conveys the document sheet that is targeted to be read by the scan function. For example, the ADF 1 includes a document sheet setting portion, a plurality of conveyance rollers, a document sheet pressing member, and a sheet ejecting portion.

The image reading portion 2 realizes the scan function. For example, the image reading portion 2 includes a document sheet table, a light source, a plurality of mirrors, an optical lens, and a CCD (Charge Coupled Device).

The image forming portion 3 realizes the print function. Specifically, the image forming portion 3 forms an image by an electrophotographic method. For example, the image forming portion 3 forms an image by using developer that includes toner (an example of developer of the present disclosure) and carrier.

The sheet feed portion 4 feeds a sheet to the image forming portion 3. For example, the sheet feed portion 4 includes sheet feed cassettes 4A (see FIG. 2), a sheet conveyance path, and a plurality of conveyance rollers.

The operation/display portion 5 is a user interface of the image forming apparatus 100. For example, the operation/display portion 5 includes a display portion and an operation portion. The display portion is, for example, a liquid crystal display and displays various types of information in response to control instructions from the first control portion 7. The operation portion is composed of, for example, operation keys or a touch panel through which various types of information are input to the first control portion 7 in response to user operations.

The storage portion 6 is a non-volatile storage device. For example, the storage portion 6 is a storage device such as: a non-volatile memory such as a flash memory or an EEPROM; an SSD (Solid State Drive); or an HDD (Hard Disk Drive).

The first control portion 7 comprehensively controls the image forming apparatus 100. As shown in FIG. 1, the first control portion 7 includes a CPU 7A, a ROM 7B, and a RAM 7C. The CPU 7A is a processor that executes various types of calculation processes. The ROM 7B is a nonvolatile storage device in which various types of information such as control programs for causing the CPU 7A to execute various processes are preliminarily stored. The RAM 7C is a volatile storage device that is used as a temporary storage memory (working area) for the various types of processes executed by the CPU 7A. In the first control portion 7, the CPU 7A executes the various types of control programs that are preliminarily stored in the ROM 7B. This allows the image forming apparatus 100 to be controlled comprehensively by the first control portion 7.

The second control portion 8 controls the image forming portion 3. For example, the second control portion 8 is composed of electronic circuits such as integrated circuits (ASIC, DSP).

The housing 9 stores some components of the image forming apparatus 100. As shown in FIG. 2, the housing 9 is formed approximately in a square pole shape. The sheet feed cassettes 4A are provided at a lower portion of the housing 9 so as to be inserted and drawn in the front-rear direction D2. A front cover 9A is provided on the front surface of the housing 9. A lower end part of the front cover 9A is supported in such a way as to be pivotable around a rotary shaft that is elongated in the left-right direction D3, and the front cover 9A is opened as its upper part pivots forward. On the housing 9, there is provided a sheet ejecting space 9B that is opened to the left and the front. A sheet with an image formed thereon by the image forming portion 3 is ejected into the sheet ejecting space 9B.

[Configuration of Image Forming Portion 3]

Figure 3:
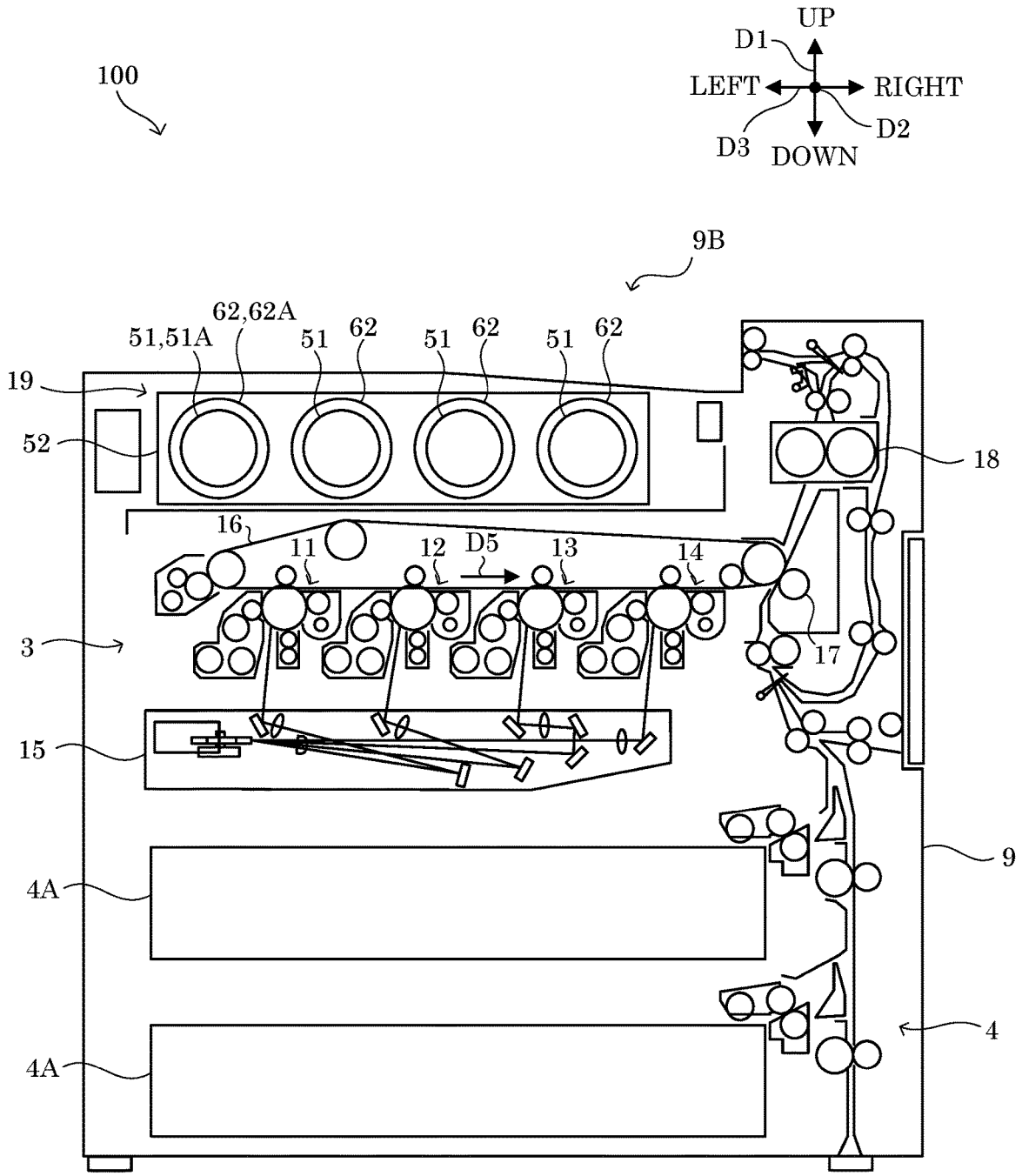
FIG. 3 is a diagram showing an internal configuration of the image forming apparatus according to the embodiment of the present disclosure.
Figure 4:
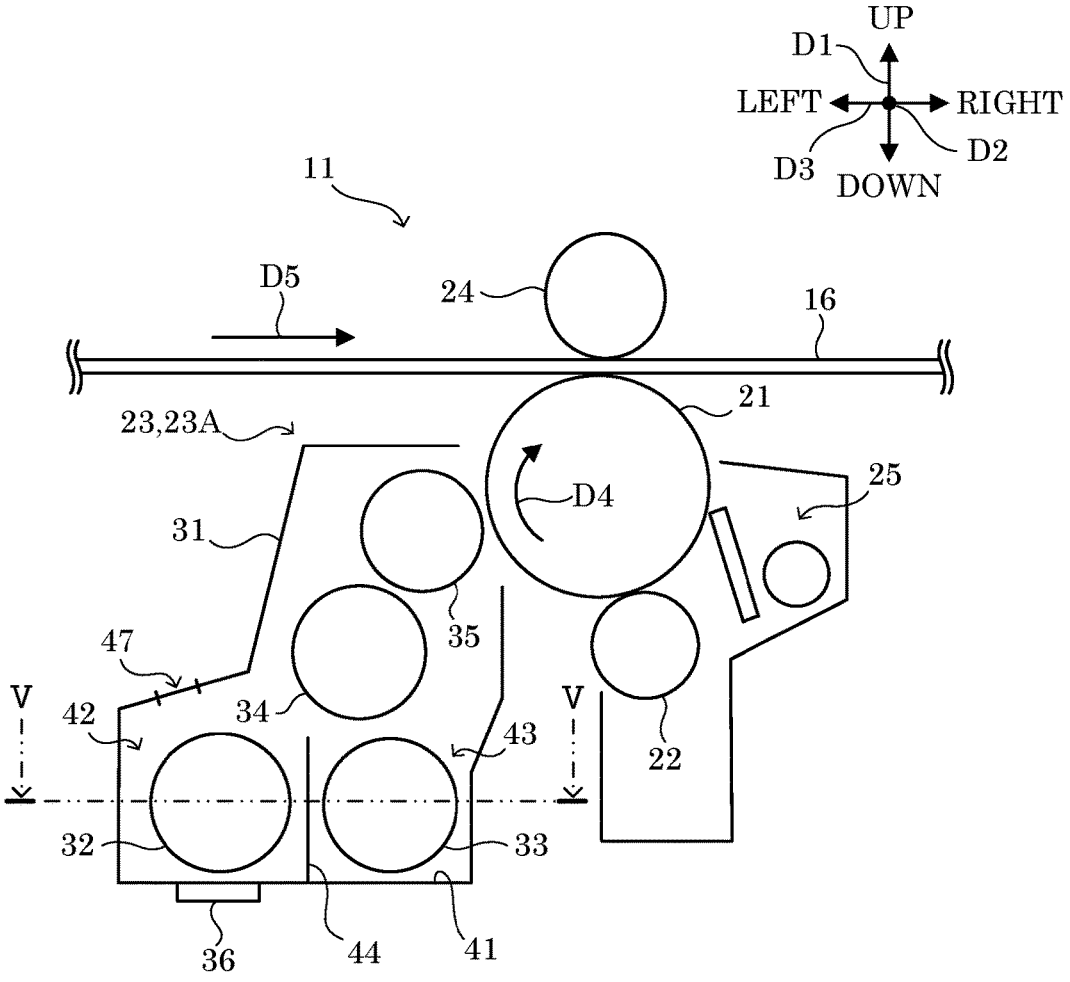
FIG. 4 is a diagram showing a configuration of an image forming unit in the image forming apparatus according to the embodiment of the present disclosure.

Next, a configuration of the image forming portion 3 is described with reference to FIG. 3 and FIG. 4. FIG. 3 is a cross-sectional diagram showing an internal configuration of the housing 9. FIG. 4 is a cross-sectional diagram showing a configuration of an image forming unit 11.

As shown in FIG. 3, the image forming portion 3 includes a plurality of image forming units 11 to 14, a laser scanning unit 15, an intermediate transfer belt 16, a secondary transfer roller 17, a fixing device 18, a toner supply device 19, and a temperature sensor 20 (see FIG. 1).

The image forming units 11 to 14 are electrophotographic image forming units, the image forming unit 11 corresponding to Y (yellow), the image forming unit 12 corresponding to C (cyan), the image forming unit 13 corresponding to M (magenta), and the image forming unit 14 corresponding to K (black). As shown in FIG. 3, the image forming units 11 to 14 are aligned along the left-right direction D3 of the image forming apparatus 100, in the order of yellow, cyan, magenta, and black from the left side of the image forming apparatus 100.

As shown in FIG. 4, the image forming unit 11 includes a photoconductor drum 21, a charging roller 22, a developing portion 23, a primary transfer roller 24, and a drum cleaning portion 25. In addition, the image forming units 12 to 14 have the same configuration as the image forming unit 11.

An electrostatic latent image is formed on a surface of the photoconductor drum 21. Upon receiving a rotational driving force supplied from a motor (not shown), the photoconductor drum 21 rotates in a rotation direction D4 as shown in FIG. 4.

The charging roller 22 electrically charges the surface of the photoconductor drum 21. Light that is emitted from the laser scanning unit 15 based on the image data, is irradiated on the surface of the photoconductor drum 21 that has been electrically charged by the charging roller 22. This allows the electrostatic latent image to be formed on the surface of the photoconductor drum 21.

The developing portion 23 develops the electrostatic latent image formed on the surface of the photoconductor drum 21 by using the developer. This allows a toner image to be formed on the surface of the photoconductor drum 21.

The primary transfer roller 24 transfers the toner image that has been formed by the developing portion 23, from the surface of the photoconductor drum 21 to the intermediate transfer belt 16.

The drum cleaning portion 25 removes the toner remaining on the surface of the photoreceptor drum 21 after the transfer of the toner image by the primary transfer roller 24.

The laser scanning unit 15 emits light based on the image data, toward surfaces of the photoconductor drums 21 of the image forming units 11 to 14.

The intermediate transfer belt 16 is an endless belt member to which the toner images formed on the surfaces of the photoconductor drums 21 of the image forming units 11 to 14 are transferred. The intermediate transfer belt 16 is stretched by a drive roller and a stretch roller with a predetermined tension. The drive roller is rotated in response to a rotational driving force that is supplied from a motor (not shown), and thereby the intermediate transfer belt 16 rotates in a rotation direction D5 as shown in FIG. 3.

The secondary transfer roller 17 transfers the toner image that has been transferred onto the surface of the intermediate transfer belt 16, to the sheet that is fed from the sheet feed portion 4.

The fixing device 18 fixes the toner image that has been transferred to the sheet by the secondary transfer roller 17, to the sheet.

The toner supply device 19 supplies the toner to the developing portions 23 of the image forming units 11 to 14.

The temperature sensor 20 detects the temperature inside the housing 9. The temperature sensor 20 is disposed at any position inside the housing 9. For example, the temperature sensor 20 is disposed at a container attachment portion 52 of the toner supply device 19. It is noted that the temperature sensor 20 may be disposed outside the housing 9 to detect the temperature of the place where the image forming apparatus 100 is installed.

[Configuration of Developing Portion 23]

Figure 5:
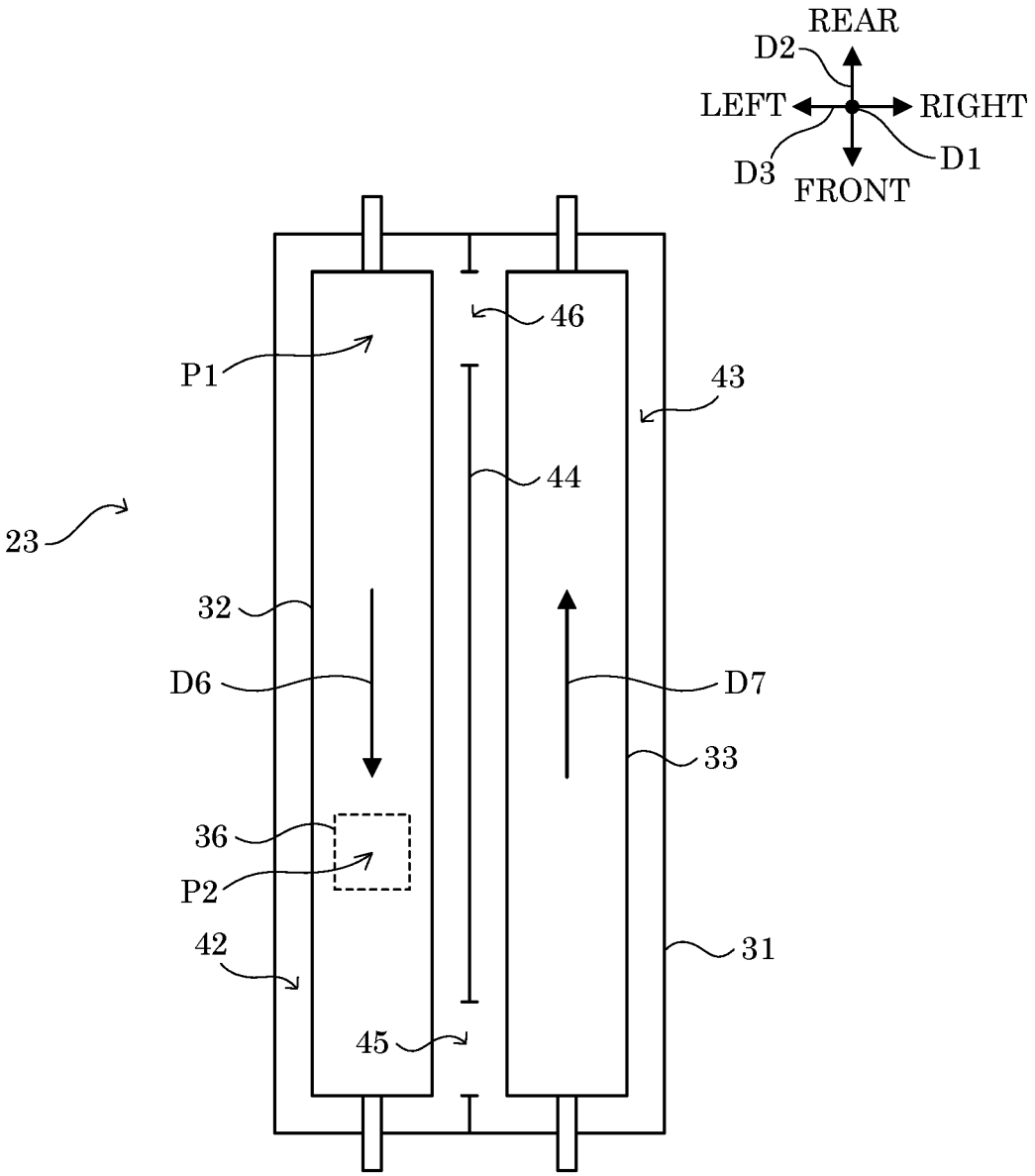
FIG. 5 is a diagram showing a configuration of a developing portion in the image forming apparatus according to the embodiment of the present disclosure.

Next, a configuration of the developing portion 23 is described with reference to FIG. 4 and FIG. 5. FIG. 5 is a cross-sectional diagram taken along a V-V line and viewed from the direction of arrows shown in FIG. 4.

As shown in FIG. 4 and FIG. 5, the developing portion 23 includes a housing 31, a first conveyance member 32, a second conveyance member 33, a magnet roller 34, a developing roller 35, and a toner sensor 36.

As shown in FIG. 4, the housing 31 stores the first conveyance member 32, the second conveyance member 33, the magnet roller 34, and the developing roller 35. In addition, the housing 31 stores the developer. Specifically, the housing 31 stores the developer in an internal space formed by side walls and a bottom surface 41. The developing portion 23 develops the electrostatic latent image that has been formed on the surface of the photoconductor drum 21 by using the developer stored in the housing 31. The housing 31 is an example of a storage portion of the present disclosure.

As shown in FIG. 5, the housing 31 includes a first conveyance path 42 and a second conveyance path 43 along which the developer including the toner is conveyed. Specifically, as shown in FIG. 4 and FIG. 5, a partition wall 44 is formed on the bottom surface 41 of the housing 31. The side walls, the bottom surface 41, and the partition wall 44 of the housing 31 form the first conveyance path 42 and the second conveyance path 43 along which the developer is conveyed in the housing 31.

As shown in FIG. 5, the first conveyance member 32 is provided in the first conveyance path 42. The first conveyance member 32 conveys the developer in a conveyance direction D6 along the front-rear direction D2 in the first conveyance path 42, and electrically charges the toner included in the developer. Specifically, the first conveyance member 32 stirs the developer during the conveyance of the developer to electrically charge the toner included in the developer. For example, the first conveyance member 32 is a screw-shaped member.

As shown in FIG. 5, the second conveyance member 33 is provided in the second conveyance path 43. The second conveyance member 33 conveys the developer in a conveyance direction D7 along the front-rear direction D2 in the second conveyance path 43, and electrically charges the toner included in the developer. Specifically, the second conveyance member 33 stirs the developer during the conveyance of the developer to electrically charge the toner included in the developer. For example, the second conveyance member 33 is a screw-shaped member.

A first connection portion 45 through which the first conveyance path 42 is connected with the second conveyance path 43, is provided at a downstream end of the partition wall 44 in the conveyance direction D6. On the other hand, a second connection portion 46 through which the first conveyance path 42 is connected with the second conveyance path 43, is provided at a downstream end of the partition wall 44 in the conveyance direction D7. This allows the developer stored in the housing 31 to be circulated and conveyed along the first conveyance path 42 and the second conveyance path 43 by the first conveyance member 32 and the second conveyance member 33.

The magnet roller 34 draws up the developer conveyed by the second conveyance member 33, from the second conveyance path 43. In addition, the magnet roller 34 supplies, to the developing roller 35, the toner included in the developer drawn up from the second conveyance path 43. The developing roller 35 develops the electrostatic latent image formed on the surface of the photoconductor drum 21, by using the toner supplied from the magnet roller 34.

It is noted that the development method adopted by the developing portion 23 is not limited to the two-component development method using the developer that includes the toner and the carrier. For example, the development method of the developing portion 23 may be one-component development method that uses only the toner. In addition, the developing portion 23 may not include the magnet roller 34.

An opening portion 47 is provided above the first conveyance path 42. As shown in FIG. 4, the opening portion 47 is provided in an upper surface of the housing 31 that covers the first conveyance path 42 from above. The opening portion 47 is provided facing an upstream end, in the conveyance direction D6, of the first conveyance path 42. The opening portion 47 is used to charge the toner supplied from a toner container 51, into the first conveyance path 42, wherein the toner container 51 is described below. Specifically, the toner supplied from the toner container 51 is charged into the first conveyance path 42 through the opening portion 47 at a charging position P1 (see FIG. 5) of the first conveyance path 42. The charging position P1 is a position on the bottom surface 41 facing the opening portion 47.

The toner sensor 36 detects an amount of toner at a detection position P2 (see FIG. 5) positioned on a more downstream side in the conveyance direction D6 than the charging position P1 in the first conveyance path 42. For example, as shown in FIG. 4, the toner sensor 36 is provided at a bottom surface portion of the housing 31. For example, the toner sensor 36 is a magnetic permeability sensor including an LC oscillation circuit that outputs an electric signal corresponding to a magnetic permeability of the developer stored in the housing 31.

For example, in the image forming apparatus 100, the amount of toner stored in the housing 31 is obtained by integrating the values detected by the toner sensor 36 during a detection period that is longer than the time required for the first conveyance member 32 to convey the toner from the charging position P1 to the detection position P2. For example, the detection period equals to the time required for the toner conveyed by the first conveyance member 32 to circulate inside the developing portion 23 once.

[Configuration of Toner Supply Device 19]

Figure 6:
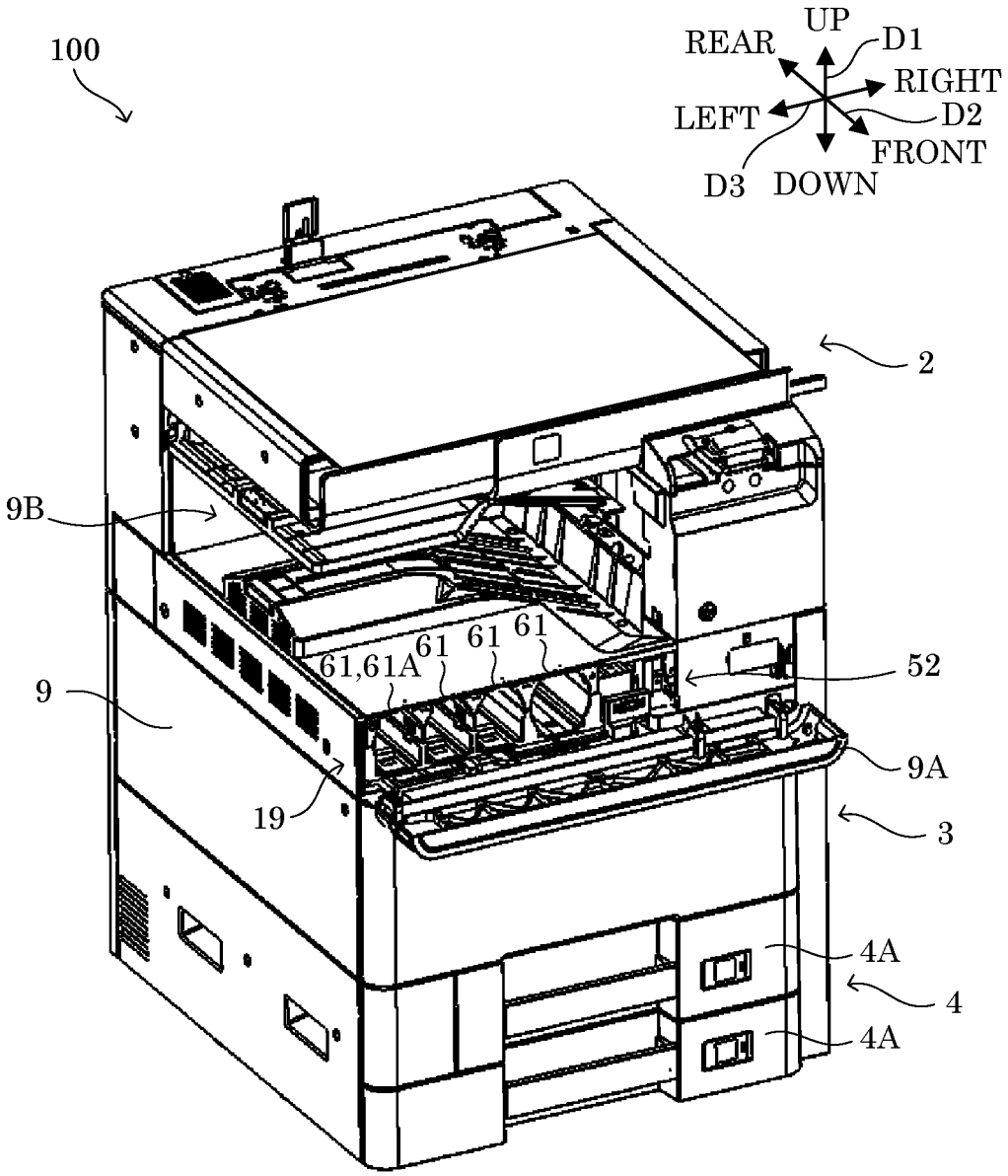
FIG. 6 is a diagram showing an outer appearance of the image forming apparatus according to the embodiment of the present disclosure.
Figure 7:
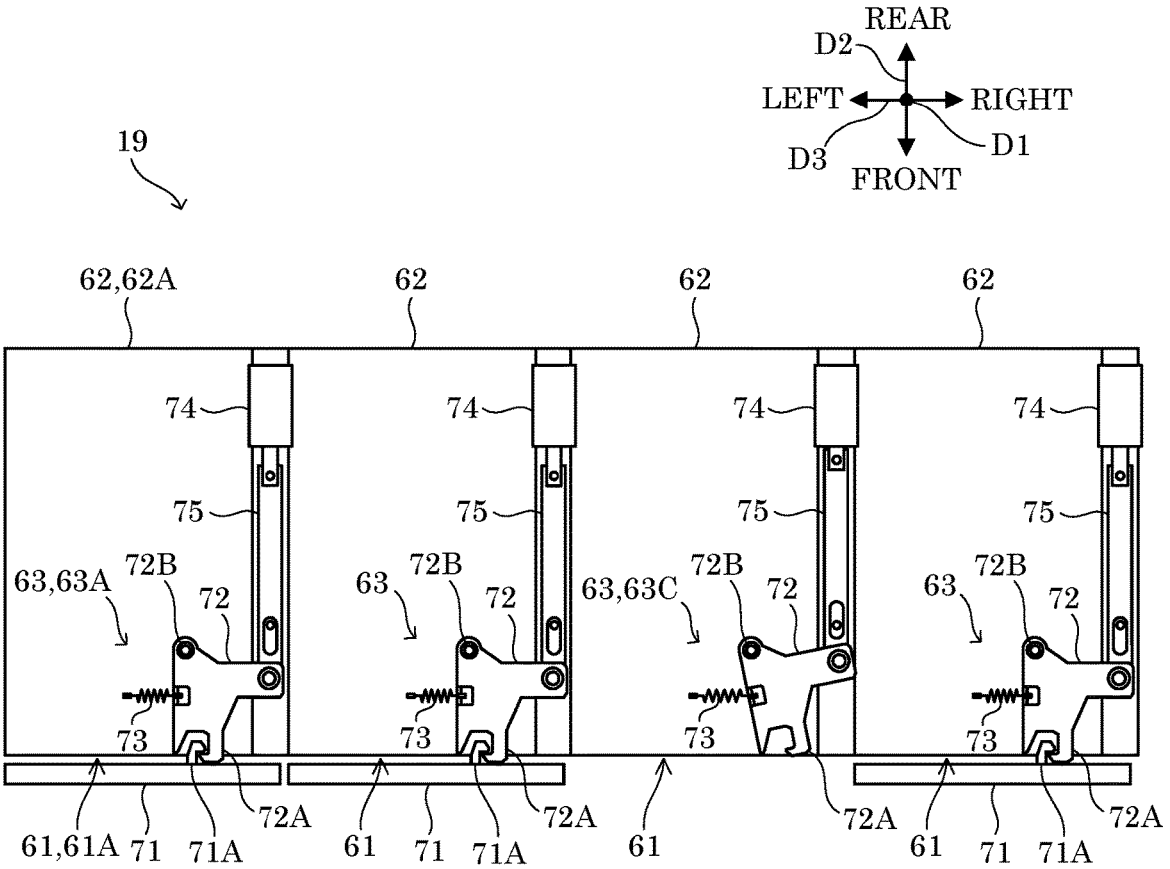
FIG. 7 is a diagram showing a configuration of a toner supply device in the image forming apparatus according to the embodiment of the present disclosure.

Next, a configuration of the toner supply device 19 is described with reference to FIG. 1 to FIG. 3 and FIG. 6 to FIG. 7. FIG. 6 is a diagram showing a state where a lock unit 53 is removed from the image forming apparatus 100 shown in FIG. 2. In addition, FIG. 7 is a plan diagram showing a configuration of the toner supply device 19.

The toner supply device 19 includes four toner containers 51 shown in FIG. 3, a container attachment portion 52 shown in FIG. 6, and the lock unit 53 shown in FIG. 2. In addition, as shown in FIG. 1, the toner supply device 19 includes a drive portion 54, a data acquiring portion 55, and an open/closed sensor 56.

The four toner containers 51 are provided in correspondence with the image forming units 11 to 14. For example, a toner container 51A shown in FIG. 3 corresponds to the image forming unit 11 and stores yellow toner.

The four toner containers 51 have the same configuration. Specifically, the toner containers 51 are each formed approximately in the shape of a cylinder elongated along the front-rear direction D2. Each toner container 51 includes a conveyance member (not shown) that conveys the toner stored therein along the longitudinal direction thereof, and an IC tag (not shown) that stores specific data regarding the toner container 51. For example, the specific data includes identification information of the toner container 51, toner information regarding the type, material, and color of the toner stored in the toner container 51, and initial storage amount information that indicates an initial storage amount of toner in the toner container 51. The toner container 51 is an example of a developer storage portion of the present disclosure.

Four toner containers 51 are attached to the container attachment portion 52. As shown in FIG. 3, the container attachment portion 52 is provided at an upper part of the housing 9. In addition, as shown in FIG. 6, the container attachment portion 52 is provided in the housing 9 at a position facing a back surface of the front cover 9A. Four opening portions 61 (see FIG. 6) and four attachment portions 62 (see FIG. 3) are formed in the container attachment portion 52.

The four opening portions 61 are provided in correspondence with the four toner containers 51. The toner containers 51 are respectively inserted in the opening portions 61. For example, the toner container 51A is inserted in an opening portion 61A shown in FIG. 6.

The four attachment portions 62 are provided in correspondence with the four opening portions 61. Each attachment portion 62 forms a storage space for storing a toner container 51 that extends from the corresponding opening portion 61 toward the rear of the image forming apparatus 100. The toner containers 51 are respectively attached to the attachment portions 62. For example, the toner container 51A is attached to an attachment portion 62A shown in FIG. 3.

The lock unit 53 is configured to regulate removal of the toner containers 51 attached to the container attachment portion 52, from the container attachment portion 52. As shown in FIG. 2, the lock unit 53 is mounted to the front of the container attachment portion 52. The lock unit 53 includes four lock devices 63 that are configured to individually switch between placing and not placing restrictions on opening and closing of the four opening portions 61. That is, the four lock devices 63 are configured to individually switch between locking and unlocking the four opening portions 61.

The four lock devices 63 have the same configuration. Specifically, as shown in FIG. 7, each lock device 63 includes a lock cover 71, a restriction member 72, a coil spring 73, a solenoid 74, and a link member 75. The restriction member 72, the coil spring 73, the solenoid 74, and the link member 75 in each lock device 63 are provided on an upper surface of the corresponding attachment portion 62. Each lock device 63 regulates the removal of a toner container 51 attached to a corresponding attachment portion 62, from the attachment portion 62. The lock device 63 is an example of a regulation portion of the present disclosure.

The lock cover 71 is provided at each opening portion 61 in such a way as to open and close the opening portion 61. The lock cover 71 is supported such that its lower end portion is pivotable around a rotary shaft that is elongated in the left-right direction D3. That is, the lock cover 71 is opened as its upper part pivots forward, in the same manner as the front cover 9A.

An engaged portion 71A configured to be engaged with an engaging portion 72A of the restriction member 72, is provided at the upper part of the lock cover 71. As shown in FIG. 7, the engaged portion 71A has a hook shape that protrudes from the back surface of the lock cover 71 and bends to the right.

The restriction member 72 includes the engaging portion 72A configured to be engaged with the engaged portion 71A of the lock cover 71. As shown in FIG. 7, the engaging portion 72A has a hook shape that protrudes forward and bends to the left. The restriction member 72 is pivotably provided on the upper surface of each attachment portion 62. Specifically, the restriction member 72 is pivotably supported by a rotary shaft 72B that is provided parallel to the up-down direction D1, on the upper surface of each attachment portion 62.

The restriction member 72 is configured to be rotated between: a lock position where opening of the lock cover 71 is restricted; and a release position where restriction on opening of the lock cover 71, namely lock of the lock cover 71, is released. Here, as shown in FIG. 7, the lock position is a position where the engaging portion 72A is engaged with the engaged portion 71A of the closed lock cover 71. In addition, the release position is more inside the lock cover 71 than the lock position, and is a position where the engagement between the engaging portion 72A and the engaged portion 71A of the lock cover 71 is released (see a lock device 63C in FIG. 7). In the lock device 63, opening of the lock cover 71 is restricted by the restriction member 72, and thereby attachment/detachment of a toner container 51 to/from the corresponding attachment portion 62 is regulated.

The coil spring 73 biases the restriction member 72 toward the lock position. Specifically, as shown in FIG. 7, the coil spring 73 is provided on the upper surface of each attachment portion 62 to extend in the left-right direction D3. One end of the coil spring 73 in the longitudinal direction thereof is fixed to a left side portion of the restriction member 72, the other end being fixed to the upper surface of each attachment portion 62. The coil spring 73 is fixed to the restriction member 72 and the upper surface of each attachment portion 62 in a state of being stretched to be longer than its natural length. Therefore, the restriction member 72 is pulled by the coil spring 73 leftward and biased toward the lock position.

As shown in FIG. 7, the solenoid 74 is provided more inside the lock cover 71 than the restriction member 72. The solenoid 74 is driven in response to energization to move the restriction member 72 to the release position. Specifically, the solenoid 74 has what is called a pull-type driven configuration, and has a plunger that is elongated in the front-rear direction D2. The plunger is connected to the restriction member 72 via the link member 75 that is elongated in the front-rear direction D2.

The solenoid 74 drives the plunger rearward in response to a power supply from a power source (not shown) that is started based on a control instruction from the first control portion 7. This allows the restriction member 72 that is connected to the plunger via the link member 75, to be moved from the lock position to the release position, releasing the lock of the lock cover 71 (see the lock device 63C in FIG. 7).

The drive portion 54 is provided in each attachment portion 62. The drive portion 54 generates a rotational driving force that is supplied to the conveyance member of a toner container 51 attached to an attachment portion 62 corresponding to the drive portion 54. For example, the drive portion 54 is a motor. The rotational driving force generated in the drive portion 54 is supplied to the conveyance member of the toner container 51 attached to the corresponding attachment portion 62 via a power transmission mechanism (not shown). This allows the conveyance member to be rotated so that the toner stored in the toner container 51 is conveyed to a toner outlet (not shown) provided inside the toner container 51. The toner outlet of the toner container 51 attached to the corresponding attachment portion 62 is connected to a toner supply path (not shown) leading to the opening portion 47 (see FIG. 4) of the developing portion 23. The toner that is discharged from the toner outlet to the outside of the toner container 51 is supplied to the developing portion 23 via the toner supply path and the opening portion 47.

The data acquiring portion 55 is provided in each attachment portion 62. The data acquiring portion 55 acquires the specific data from the IC tag of a toner container 51 attached to an attachment portion 62 corresponding to the data acquiring portion 55. For example, the data acquiring portion 55 receives the specific data from the IC tag by executing short-range wireless communication with the IC tag of the toner container 51 attached to the corresponding attachment portion 62.

The open/closed sensor 56 detects whether the front cover 9A of the housing 9 is in an open state or a closed state. For example, the open/closed sensor 56 is a reflective optical sensor.

[Configuration of First Control Portion 7]

Next, a configuration of the first control portion 7 is described with reference to FIG. 1.

As shown in FIG. 1, the first control portion 7 includes a detection processing portion 91, a supply processing portion 92, a release processing portion 93, a first restriction processing portion 94, a regulation processing portion 95, a second restriction processing portion 96, and a notification processing portion 97.

Specifically, a storage amount monitoring program for causing the CPU 7A of the first control portion 7 to execute a storage amount monitoring process (see a flowchart of FIG. 8) that is described below, is preliminarily stored in the ROM 7B of the first control portion 7. The CPU 7A of the first control portion 7 functions as the above-described portions by executing the storage amount monitoring program stored in the ROM 7B.

It is noted that the storage amount monitoring program may be recorded on a non-transitory computer-readable recording medium such as a CD, a DVD, or a flash memory, and may be read from the recording medium and installed in a storage device such as the storage portion 6.

The following describes an example case where, among the developing portions 23, the toner containers 51, the attachment portions 62, and the lock devices 63 corresponding to the image forming units 11 to 14, the developing portion 23A (see FIG. 4), the toner container 51A (see FIG. 3), the attachment portion 62A (see FIG. 3), and the lock device 63A (see FIG. 2) corresponding to the image forming unit 11 are focused. The following description also applies to the toner containers 51, the attachment portions 62, and the lock devices 63 that correspond to the image forming units 12 to 14.

The detection processing portion 91 detects an amount of toner stored in the housing 31 of the developing portion 23A.

Specifically, the detection processing portion 91 detects the amount of toner stored in the housing 31 of the developing portion 23A by using the toner sensor 36 of the developing portion 23A. For example, the detection processing portion 91 detects the amount of toner stored in the housing 31 of the developing portion 23A each time a predetermined detection timing comes during an execution of a print process in which the image forming portion 3 forms an image on a sheet. For example, the detection timing comes in a predetermined period.

In a case where the amount of toner stored in the housing 31 of the developing portion 23A is equal to or smaller than a predetermined first threshold, the supply processing portion 92 supplies the toner from the toner container 51A attached to the attachment portion 62A to the housing 31 of the developing portion 23A. This restricts the amount of toner stored in the housing 31 of the developing portion 23A from being reduced greatly below the first threshold until the remaining amount of toner in the toner container 51A is significantly reduced.

Specifically, in a case where the toner storage amount detected by the detection processing portion 91 is equal to or smaller than the first threshold, the supply processing portion 92 drives the drive portion 54 corresponding to the attachment portion 62A so as to cause the conveyance member in the toner container 51A to rotate by a predetermined reference amount. This allows a constant amount of toner to be supplied from the toner container 51A attached to the attachment portion 62A to the housing 31 of the developing portion 23A.

When the storage amount of toner in the housing 31 of the developing portion 23A is equal to or smaller than a second threshold that is smaller than the first threshold, the release processing portion 93 releases regulation on the removal of the toner container 51A imposed by the lock device 63A. With this configuration, as compared with a configuration where the toner container 51A can be replaced at an arbitrary timing, it is possible to reduce the remaining amount of toner in the toner container 51A at the time of a replacement of the toner container 51A.

Specifically, in a case where the toner storage amount detected by the detection processing portion 91 is equal to or smaller than the second threshold, the release processing portion 93 drives the solenoid 74 of the lock device 63A so as to move the restriction member 72 of the lock device 63A from the lock position to the release position. This releases regulation on the removal of the toner container 51A imposed by the lock device 63A.

When the storage amount of toner in the housing 31 of the developing portion 23A is equal to or smaller than a third threshold that is lower than the second threshold, the first restriction processing portion 94 imposes restriction on the operation of the image forming portion 3.

Specifically, in a case where the toner storage amount detected by the detection processing portion 91 is equal to or smaller than the third threshold, the first restriction processing portion 94 stops a currently executed print process and prohibits the print process from being newly executed.

In a case where the storage amount of toner in the housing 31 of the developing portion 23A is larger than the second threshold, and the removal of the toner container 51A has not been regulated by the lock device 63A, the regulation processing portion 95 causes the lock device 63A to regulate the removal of the toner container 51A. With this configuration, in a case where the amount of toner stored in the developing portion 23A temporarily becomes equal to or smaller than the second threshold due to low liquidity of the toner in the toner container 51A in a state where much toner remains in the toner container 51A, it is possible to inhibit the replacement of the toner container 51A.

It is noted that the toner in the toner container 51A partly solidifies and the liquidity thereof decreases in a case where the toner container 51A is reserved in the low temperature environment, or in a case where the toner container 51A that is formed approximately in a cylindrical shape, is kept standing on a floor surface.

Specifically, in a case where the toner storage amount detected by the detection processing portion 91 is larger than the second threshold, and the removal of the toner container 51A has not been regulated by the lock device 63A, the regulation processing portion 95 drives the solenoid 74 of the lock device 63A so as to move the restriction member 72 of the lock device 63A from the release position to the lock position. This allows the lock device 63A to impose regulation on the removal of the toner container 51A.

Figure 12:
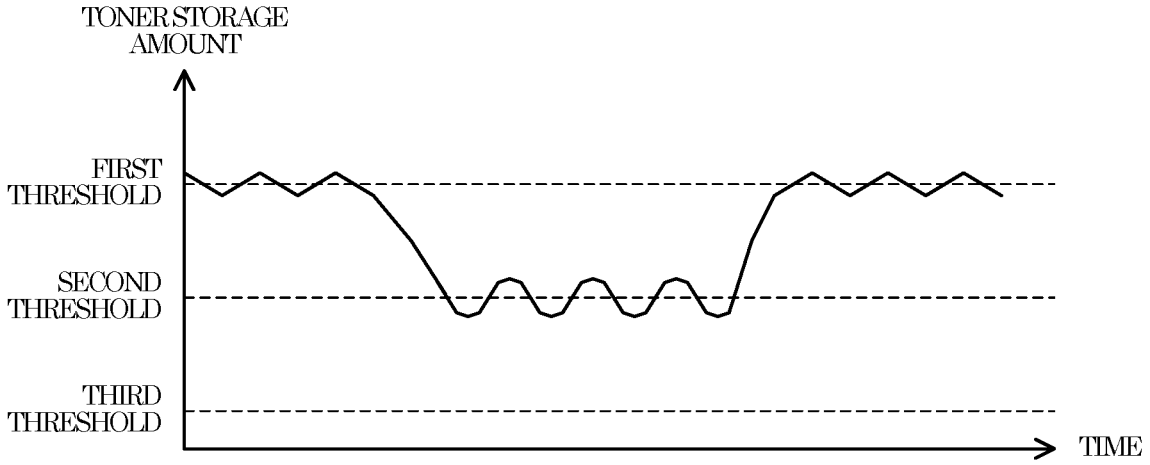
FIG. 12 is a diagram showing an example of changes in a toner storage amount of the developing portion of the image forming apparatus according to the embodiment of the present disclosure.

Meanwhile, in the image forming apparatus 100, as shown in FIG. 12, the amount of toner in the developing portion 23A may be repeatedly decreased and increased around the second threshold when the liquidity of the toner in the toner container 51A is low. In that case, the release of the regulation on the removal of the toner container 51A and the regulation on the removal of the toner container 51A may be repeated, and the sound that is emitted when the lock device 63A is driven to regulate the removal of the toner container 51A may become a noise. In addition, parts of the lock device 63A may be worn out, resulting in a damage of the lock device 63A.

On the other hand, as described below, in the image forming apparatus 100 according to the embodiment of the present disclosure, it is possible to reduce the remaining amount of toner in the toner container 51A at the time of replacement of the toner container 51A, and inhibit the lock device 63A that regulates the removal of the toner container 51A, from generating a noise.

In a case where a predetermined restriction condition is satisfied when the release processing portion 93 releases regulation on the removal of the toner container 51A, the second restriction processing portion 96 imposes restriction on processing of the regulation processing portion 95.

For example, the restriction condition is that the number of releases performed by the release processing portion 93 and counted during a time period from when the release processing portion 93 starts a release to when the first restriction processing portion 94 imposes restriction on the operation of the image forming portion 3, reaches a predetermined first reference value, and an elapsed time that is a time taken for the number of releases to reach the first reference value, does not exceed a predetermined first reference time. This makes it possible to impose restriction on the processing of the regulation processing portion 95 only in a case where the release of the regulation on the removal of the toner container 51A and the regulation on the removal of the toner container 51A are repeated, and the lock device 63A frequently generates a noise. For example, the first reference value is 4 (four), and the first reference time is 5 (five) seconds. It is noted that the first reference value and the first reference time may be determined in an arbitrary manner.

For example, the second restriction processing portion 96 sets a predetermined regulation flag to "1" when the regulation on the removal of the toner container 51A is released by the release processing portion 93 and the restriction condition is satisfied. It is noted that in the image forming apparatus 100: restriction is imposed on the processing of the regulation processing portion 95 when the regulation flag has been set to "1"; and restriction is not imposed on the processing of the regulation processing portion 95 when the regulation flag has been set to "0".

In addition, the second restriction processing portion 96 imposes restriction on the processing of the regulation processing portion 95 until a predetermined release condition is satisfied.

For example, the release condition includes a first release condition and a second release condition. The first release condition is that restriction is imposed on the operation of the image forming portion 3 by the first restriction processing portion 94. The second release condition is that a state where the amount of toner stored in the housing 31 of the developing portion 23A is larger than a predetermined fourth threshold, continues for more than a predetermined second reference time. Here, the fourth threshold is smaller than the first threshold and equal to or greater than the second threshold. In addition, the second reference time is 5 (five) seconds. It is noted that the fourth threshold and the second reference time may be determined in an arbitrary manner.

For example, the second restriction processing portion 96 sets the regulation flag to "0" when the release condition is satisfied after imposing restriction on the processing of the regulation processing portion 95.

It is noted that the restriction condition may be that the number of releases reaches the first reference value.

In addition, the restriction condition may include that the remaining amount of toner in the toner container 51A is equal to or smaller than a predetermined second reference value. It is noted that the second reference value may be determined in an arbitrary manner.

For example, in the image forming apparatus 100, each time the print process is executed, an amount of toner consumed in the print process is recorded. For example, the first control portion 7 acquires the amount of toner consumed in the print process based on a printing rate of the image data printed in the print process. In addition, the first control portion 7 stores the acquired consumed amount of toner in a predetermined storage area of the storage portion 6, together with information of the execution timing of the print process or the like.

In addition, the second restriction processing portion 96 is configured to acquire the remaining amount of toner in the toner container 51A attached to the attachment portion 62A based on: the total amount of toner consumed from the use start timing of the toner container 51A; and the initial storage amount information included in the specific data acquired from the IC tag of the toner container 51A by the data acquiring portion 55 corresponding to the attachment portion 62A.

For example, when the remaining amount of toner in the toner container 51A is equal to or smaller than the second reference value, the second restriction processing portion 96 imposes restriction on the processing of the regulation processing portion 95 regardless of the number of releases; and when the remaining amount of toner is larger than the second reference value, the second restriction processing portion 96 imposes restriction on the processing of the regulation processing portion 95 based on the number of releases. This makes it possible to prevent the remaining amount of toner in the toner container 51A at the time of replacement from being increased and prevent the lock device 63A from generating a noise.

In addition, the restriction condition may include that the temperature in the image forming apparatus 100 is lower than a predetermined reference temperature. It is noted that the reference temperature may be determined in an arbitrary manner to fall within a range considered to influence the solidification of the toner in the toner container 51A.

For example, when the temperature detected by the temperature sensor 20 is lower than the reference temperature, the second restriction processing portion 96 imposes restriction on the processing of the regulation processing portion 95 regardless of the number of releases; and when the temperature detected by the temperature sensor 20 is equal to or higher than the reference temperature, the second restriction processing portion 96 imposes restriction on the processing of the regulation processing portion 95 based on the number of releases.

In addition, the restriction condition may include that a current value of electric current that flows through the drive portion 54 is equal to or greater than a predetermined third reference value. It is noted that the third reference value may be determined in an arbitrary manner based on the relationship between the fluidity of the toner in the toner container 51A and the load of the drive portion 54.

For example, when the current value of the electric current that flows through the drive portion 54 is equal to or greater than the third reference value, the second restriction processing portion 96 imposes restriction on the processing of the regulation processing portion 95 regardless of the number of releases; and when the current value is smaller than the third reference value, the second restriction processing portion 96 imposes restriction on the processing of the regulation processing portion 95 based on the number of releases.

In addition, the release condition may not include the second release condition.

The notification processing portion 97 notifies the user that the fluidity of the toner in the toner container 51A has decreased, when the second restriction processing portion 96 imposes restriction on the processing of the regulation processing portion 95.

For example, the notification processing portion 97 displays, on the operation/display portion 5, a notification screen that includes: a message that the fluidity of the toner in the toner container 51A has decreased; and a message that the decrease of the fluidity of the toner can be improved by shaking the toner container 51A.

It is noted that the first control portion 7 may not include the notification processing portion 97.

[Storage Amount Monitoring Process]

Figure 8:
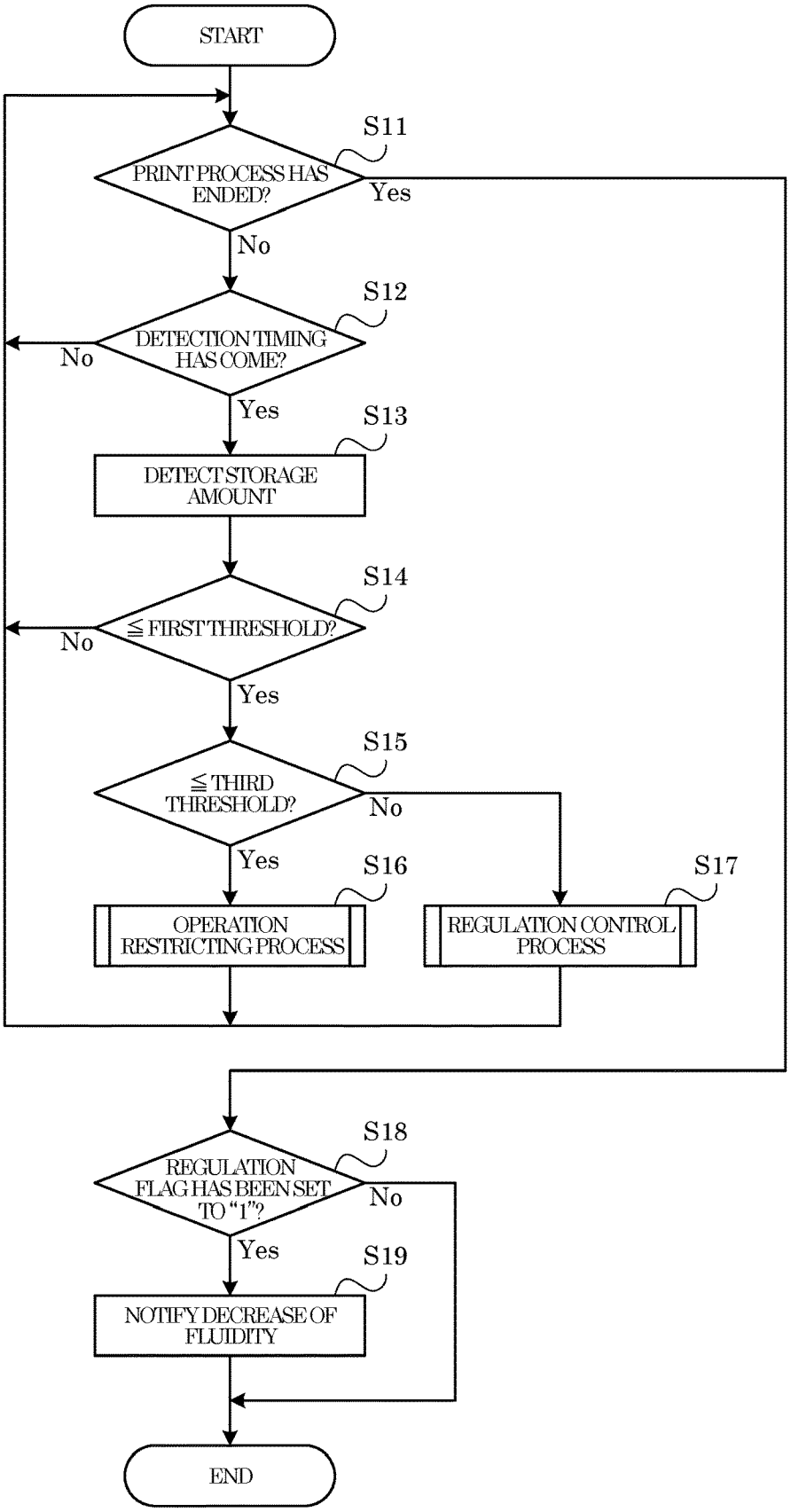
FIG. 8 is a flowchart showing an example of a storage amount monitoring process that is executed in the image forming apparatus according to the embodiment of the present disclosure.

In the following, with reference to FIG. 8, a description is given of an example of the procedure of a storage amount monitoring process executed by the first control portion 7 in the image forming apparatus 100. Here, steps S11, S12, . . . represent numbers assigned to the processing procedures (steps) executed by the first control portion 7. It is noted that the storage amount monitoring process is executed together with a print process when an instruction to execute the print process is input.

It is noted that the first control portion 7 executes a predetermined initial process at the start of execution of the storage amount monitoring process. For example, in the initial process, a first count value and a second count value are reset to zero, wherein the first count value is used to determine whether or not the restriction condition is satisfied, and the second count value is used to determine whether or not the second release condition is satisfied. In addition, in the initial process, the regulation flag is set to "0".

<Step S11>

First, in step S11, the first control portion 7 determines whether or not the print process executed together with the storage amount monitoring process has ended.

Here, upon determining that the print process executed together with the storage amount monitoring process has ended (Yes side at S11), the first control portion 7 moves the process to step S18. In addition, upon determining that the print process executed together with the storage amount monitoring process has not ended (No side at S11), the first control portion 7 moves the process to step S12.

<Step S12>

In step S12, the first control portion 7 determines whether or not the detection timing has come.

Here, upon determining that the detection timing has come (Yes side at S12), the first control portion 7 moves the process to step S13. In addition, upon determining that the detection timing has not come (No side at S12), the first control portion 7 moves the process to step S11.

<Step S13>

In step S13, the first control portion 7 detects the amount of toner stored in the housing 31 of the developing portion 23A. Here, the process of step S13 is executed by the detection processing portion 91 of the first control portion 7.

<Step S14>

In step S14, the first control portion 7 determines whether or not the amount of toner stored in the housing 31 of the developing portion 23A detected in step S13 is equal to or smaller than the first threshold.

Here, upon determining that the storage amount of toner detected in step S13 is equal to or smaller than the first threshold (Yes side at S14), the first control portion 7 moves the process to step S15. In addition, upon determining that the storage amount of toner detected in step S13 is not equal to or smaller than the first threshold (No side at S14), the first control portion 7 moves the process to step S11.

<Step S15>

In step S15, the first control portion 7 determines whether or not the amount of toner stored in the housing 31 of the developing portion 23A detected in step S13 is equal to or smaller than the third threshold.

Here, upon determining that the storage amount of toner detected in step S13 is equal to or smaller than the third threshold (Yes side at S15), the first control portion 7 moves the process to step S16. In addition, upon determining that the storage amount of toner detected in step S13 is not equal to or smaller than the third threshold (No side at S15), the first control portion 7 moves the process to step S17.

<Step S16>

In step S16, the first control portion 7 executes an operation restricting process that is described below.

<Step S17>

In step S17, the first control portion 7 executes a regulation control process that is described below.

<Step S18>

In step S18, the first control portion 7 determines whether or not the regulation flag has been set to "1".

Here, upon determining that the regulation flag has been set to "1" (Yes side at S18), the first control portion 7 moves the process to step S19. In addition, upon determining that the regulation flag has not been set to "1" (No side at S18), the first control portion 7 ends the storage amount monitoring process.

<Step S19>

In step S19, the first control portion 7 notifies the user that the fluidity of the toner in the toner container 51A has decreased. Here, the process of step S19 is executed by the notification processing portion 97 of the first control portion 7.

For example, the first control portion 7 displays, on the operation/display portion 5, the notification screen that includes: a message that the fluidity of the toner in the toner container 51A has decreased; and a message that the decrease of the fluidity of the toner can be improved by shaking the toner container 51A.

[Operation Restricting Process]

Figure 9:
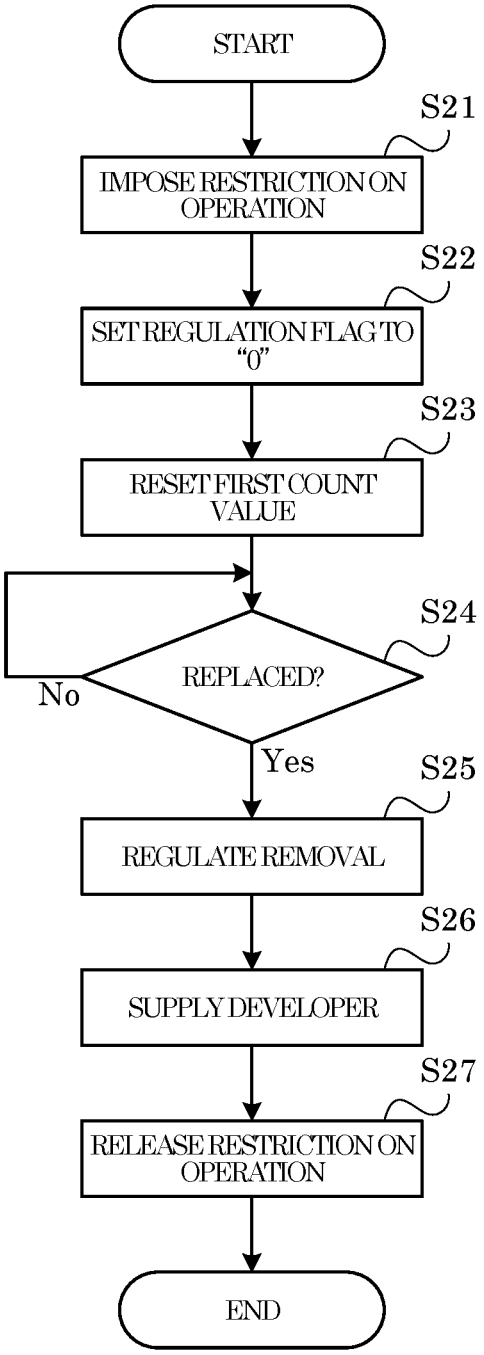
FIG. 9 is a flowchart showing an example of an operation restricting process that is executed in the image forming apparatus according to the embodiment of the present disclosure.

Next, with reference to FIG. 9, a description is given of the operation restricting process executed in step S16 of the storage amount monitoring process.

<Step S21>

First, in step S21, the first control portion 7 imposes restriction on the operation of the image forming portion 3. Here, the process of step S21 is an example of a first restriction step of the present disclosure, and is executed by the first restriction processing portion 94 of the first control portion 7.

Specifically, the first control portion 7 stops a currently executed print process and prohibits the print process from being newly executed.

<Step S22>

In step S22, the first control portion 7 sets the regulation flag to "0". That is, the first control portion 7 releases the restriction on the processing of the regulation processing portion 95 because the first release condition is satisfied by the execution of the process of step S21. Here, the process of step S22 is executed by the second restriction processing portion 96 of the first control portion 7.

<Step S23>

In step S23, the first control portion 7 resets the first count value to zero.

<Step S24>

In step S24, the first control portion 7 determines whether or not the toner container 51A has been replaced.

For example, when closing of the front cover 9A is detected by the open/closed sensor 56 while the toner container 51A is attached to the attachment portion 62A, the first control portion 7 determines that the toner container 51A has been replaced. It is noted that the first control portion 7 may determine whether or not the toner container 51A is attached to the attachment portion 62A, based on, for example, success or failure of acquisition of the specific data by the data acquisition portion 55 corresponding to the attachment portion 62A. It is noted that the first control portion 7 may determine whether or not the toner container 51A attached to the attachment portion 62A is a newly replaced one, based on the specific data acquired by the data acquiring portion 55.

Here, upon determining that the toner container 51A has been replaced (Yes side at S24), the first control portion 7 moves the process to step S25. In addition, upon determining that the toner container 51A has not been replaced (No side at S24), the first control portion 7 waits at step S24 for the toner container 51A to be replaced.

<Step S25>

In step S25, the first control portion 7 regulates removal of the toner container 51A from the attachment portion 62A.

Specifically, the first control portion 7 stops a power supply to the solenoid 74 of the lock device 63A so as to move the restriction member 72 of the lock device 63A from the release position to the lock position. This allows the lock device 63A to regulate the removal of the toner container 51A.

<Step S26>

In step S26, the first control portion 7 supplies toner from the toner container 51A attached to the attachment portion 62A to the housing 31 of the developing portion 23A.

For example, the first control portion 7 supplies toner from the toner container 51A to the housing 31 until the amount of toner stored in the housing 31 of the developing portion 23A exceeds the first threshold.

<Step S27>

In step S27, the first control portion 7 releases the restriction imposed on the operation of the image forming portion 3 that was set in step S21.

Specifically, the first control portion 7 restarts the print process that has been stopped and releases the prohibition of a new execution of the print process.

[Regulation Control Process]

Figure 10:
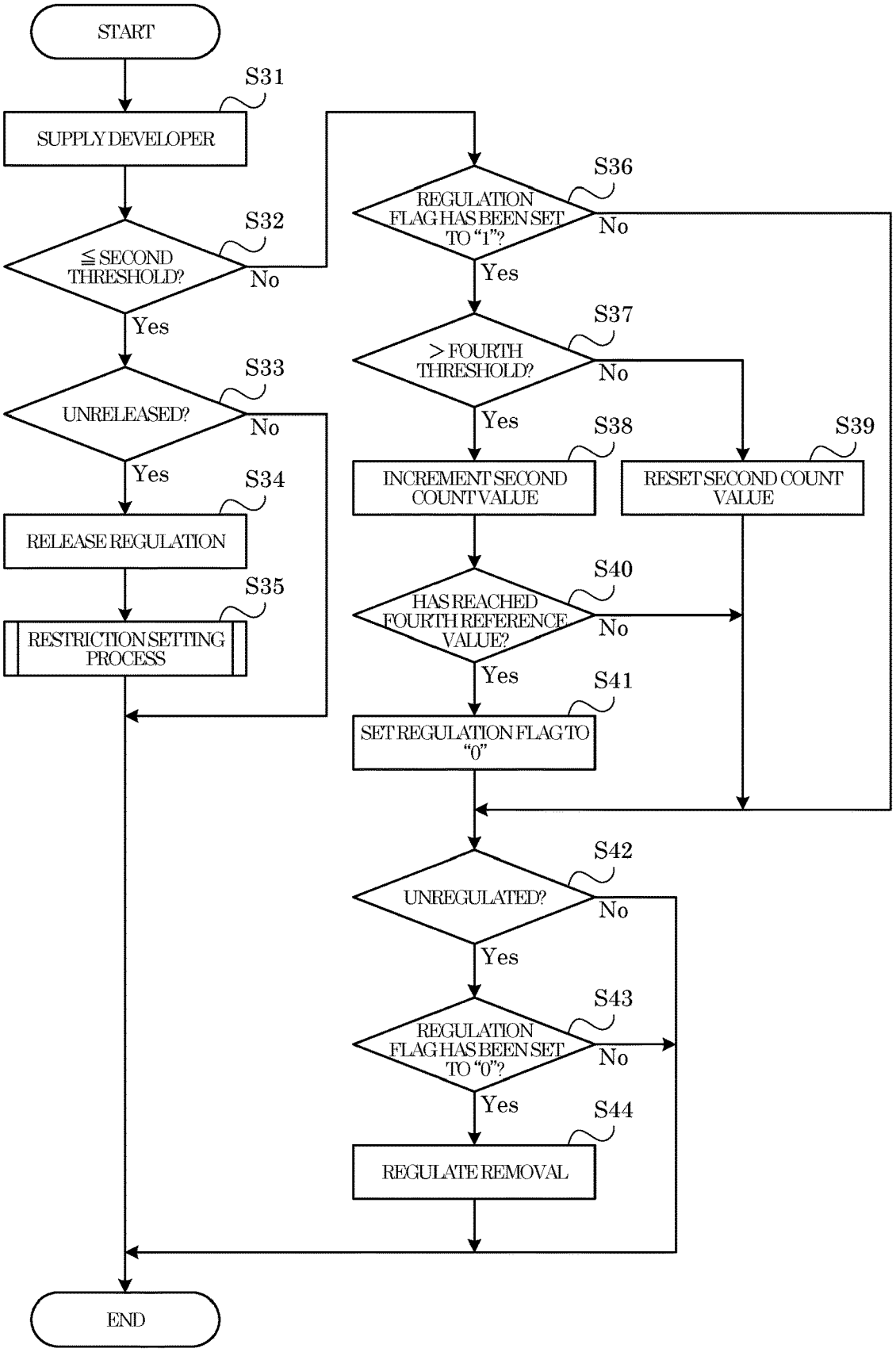
FIG. 10 is a flowchart showing an example of a regulation control process that is executed in the image forming apparatus according to the embodiment of the present disclosure.

Next, with reference to FIG. 10, a description is given of the regulation control process executed in step S17 of the storage amount monitoring process.

<Step S31>

First, in step S31, the first control portion 7 supplies toner from the toner container 51A attached to the attachment portion 62A to the housing 31 of the developing portion 23A. Here, the process of step S31 is an example of a supply step of the present disclosure, and is executed by the supply processing portion 92 of the first control portion 7.

<Step S32>

In step S32, the first control portion 7 determines whether or not the amount of toner stored in the housing 31 of the developing portion 23A detected in step S13 of the storage amount monitoring step is equal to or smaller than the second threshold.

Here, upon determining that the storage amount of toner detected in step S13 of the storage amount monitoring step is equal to or smaller than the second threshold (Yes side at S32), the first control portion 7 moves the process to step S33. In addition, upon determining that the storage amount of toner detected in step S13 of the storage amount monitoring step is not equal to or smaller than the second threshold (No side at S32), the first control portion 7 moves the process to step S36.

<Step S33>

In step S33, the first control portion 7 determines whether or not the regulation on the removal of the toner container 51A imposed by the lock device 63A has been unreleased.

Here, upon determining that the regulation on the removal of the toner container 51A imposed by the lock device 63A has been unreleased (Yes side at S33), the first control portion 7 moves the process to step S34. In addition, upon determining that the regulation on the removal of the toner container 51A imposed by the lock device 63A has not been unreleased (No side at S33), the first control portion 7 ends the regulation control process.

<Step S34>

In step S34, the first control portion 7 releases the regulation on the removal of the toner container 51A imposed by the lock device 63A. Here, the process of step S34 is an example of a release step of the present disclosure, and is executed by the release processing portion 93 of the first control portion 7.

<Step S35>

In step S35, the first control portion 7 executes a restriction setting process that is described below.

<Step S36>

In step S36, the first control portion 7 determines whether or not the regulation flag has been set to "1".

Here, upon determining that the regulation flag has been set to "1" (Yes side at S36), the first control portion 7 moves the process to step S37. In addition, upon determining that the regulation flag has not been set to "1" (No side at S36), the first control portion 7 moves the process to step S42.

<Step S37>

In step S37, the first control portion 7 determines whether or not the amount of toner stored in the housing 31 of the developing portion 23A detected in step S13 of the storage amount monitoring step is larger than the fourth threshold.

Here, upon determining that the storage amount of toner detected in step S13 of the storage amount monitoring step is larger than the fourth threshold (Yes side at S37), the first control portion 7 moves the process to step S38. In addition, upon determining that the storage amount of toner detected in step S13 of the storage amount monitoring step is not larger than the fourth threshold (No side at S37), the first control portion 7 moves the process to step S39.

<Step S38>

In step S38, the first control portion 7 increments the second count value.

<Step S39>

In step S39, the first control portion 7 resets the second count value to zero.

<Step S40>

In step S40, the first control portion 7 determines whether or not the second count value has reached a predetermined fourth reference value. Here, the fourth reference value is determined based on the second reference time and an execution period of step S13 of the storage amount monitoring process.

Here, upon determining that the second count value has reached the fourth reference value (Yes side at S40), the first control portion 7 moves the process to step S41. In addition, upon determining that the second count value has not reached the fourth reference value (No side at S40), the first control portion 7 moves the process to step S42.

<Step S41>

In step S41, the first control portion 7 sets the regulation flag to "0". That is, the first control portion 7 releases the restriction on the processing of the regulation processing portion 95 because the second release condition is satisfied when the second count value reaches the fourth reference value. In addition, the first control portion 7 resets the second count value to zero. Here, the processes of steps S36 to S41 are executed by the second restriction processing portion 96 of the first control portion 7.

<Step S42>

In step S42, the first control portion 7 determines whether or not it is in a state where the removal of the toner container 51A is not regulated by the lock device 63A.

Here, upon determining that it is in the state where the removal of the toner container 51A is not regulated by the lock device 63A (Yes side at S42), the first control portion 7 moves the process to step S43. In addition, upon determining that it is not in the state where the removal of the toner container 51A is not regulated by the lock device 63A (No side at S42), the first control portion 7 ends the regulation control process.

<Step S43>

In step S43, the first control portion 7 determines whether or not the regulation flag has been set to "0".

Here, upon determining that the regulation flag has been set to "0" (Yes side at S43), the first control portion 7 moves the process to step S44. In addition, upon determining that the regulation flag has not been set to "0" (No side at S43), the first control portion 7 ends the regulation control process. This avoids the execution of the process of step S44. That is, restriction is imposed on the processing of the regulation processing portion 95.

<Step S44>

In step S44, the first control portion 7 regulates the removal of the toner container 51A attached to the attachment portion 62A. Here, the process of step S44 is an example of a regulation step of the present disclosure, and is executed by the regulation processing portion 95 of the first control portion 7.

[Restriction Setting Process]

Figure 11:
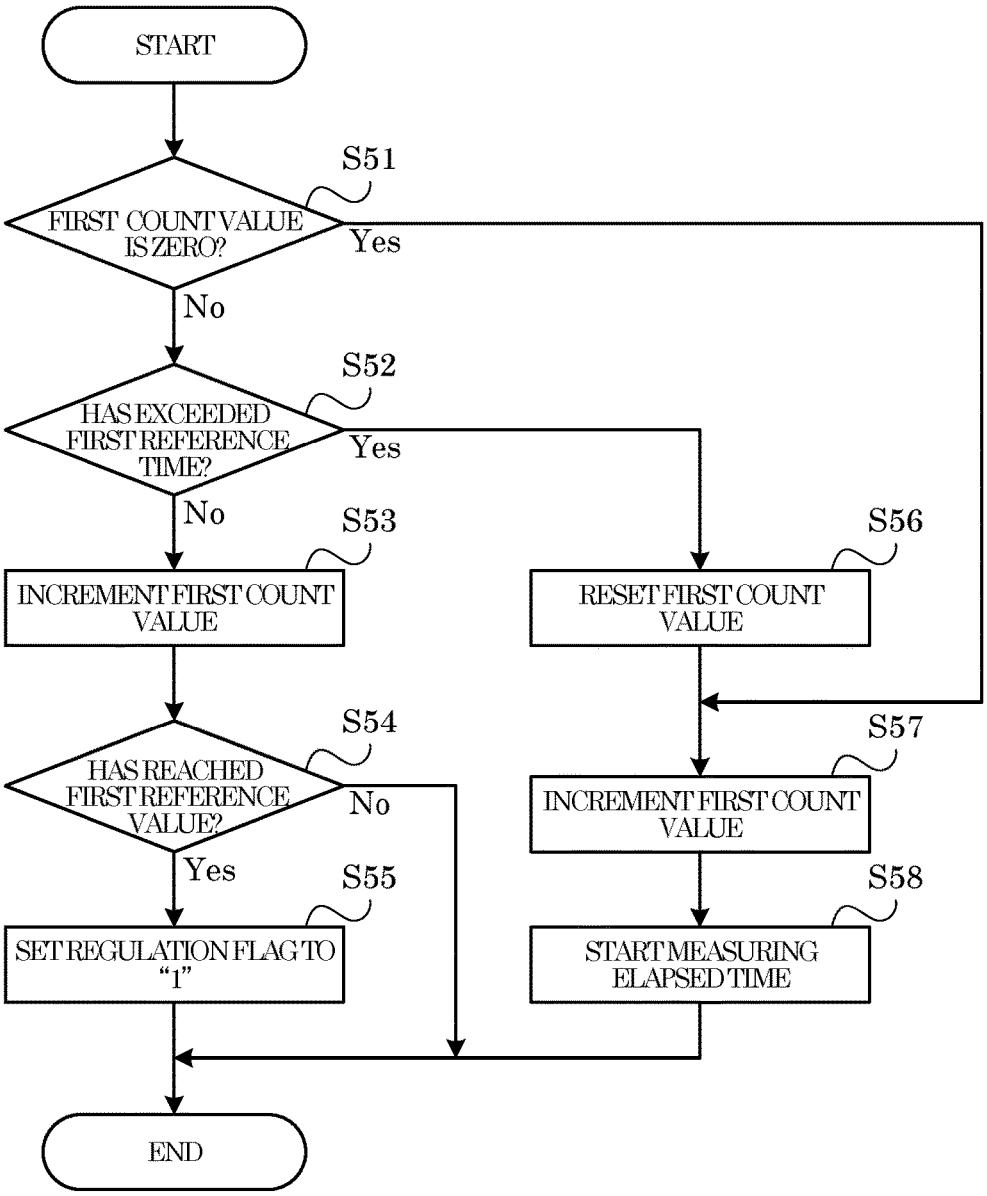
FIG. 11 is a flowchart showing an example of a restriction setting process that is executed in the image forming apparatus according to the embodiment of the present disclosure.

Next, with reference to FIG. 11, a description is given of the restriction setting process executed in step S35 of the regulation control process. Here, the restriction setting process is an example of a second restriction step of the present disclosure, and is executed by the second restriction processing portion 96 of the first control portion 7.

<Step S51>

First, in step S51, the first control portion 7 determines whether or not the first count value is zero.

Here, upon determining that the first count value is zero (Yes side at S51), the first control portion 7 moves the process to step S57. In addition, upon determining that the first count value is not zero (No side at S51), the first control portion 7 moves the process to step S52.

<Step S52>

In step S52, the first control portion 7 determines whether or not an elapsed time from a release of the regulation on the removal of the toner container 51A that starts to be measured in step S58 has exceeded the first reference time.

Here, upon determining that the elapsed time from the release of the regulation on the removal of the toner container 51A has exceeded the first reference time (Yes side at S52), the first control portion 7 moves the process to step S56. In addition, upon determining that the elapsed time from the release of the regulation on the removal of the toner container 51A has not exceeded the first reference time (No side at S52), the first control portion 7 moves the process to step S53.

<Step S53>

In step S53, the first control portion 7 increments the first count value.

<Step S54>

In step S54, the first control portion 7 determines whether or not the first count value has reached the first reference value.

Here, upon determining that the first count value has reached the first reference value (Yes side at S54), the first control portion 7 moves the process to step S55. In addition, upon determining that the first count value has not reached the first reference value (No side at S54), the first control portion 7 ends the restriction setting process.

<Step S55>

In step S55, the first control portion 7 sets the regulation flag to "1". That is, the first control portion 7 imposes restriction on the processing of the regulation processing portion 95 because the restriction condition is satisfied when the first count value reaches the first reference value. In addition, the first control portion 7 resets the first count value to zero. In addition, the first control portion 7 ends measuring the elapsed time from the release of the regulation on the removal of the toner container 51A. Here, the process of step S55 is an example of a second restriction step of the present disclosure, and is executed by the second restriction processing portion 96 of the first control portion 7.

<Step S56>

In step S56, the first control portion 7 resets the first count value to zero.

<Step S57>

In step S57, the first control portion 7 increments the first count value.

<Step S58>

In step S58, the first control portion 7 starts measuring the elapsed time from the release of the regulation on the removal of the toner container 51A (the elapsed time from the execution of step S34 of the regulation control process).

It is noted that the process of step S57 may be omitted. In this case, in step S51, the first control portion 7 determines whether or not measuring the elapsed time from the release of the regulation on the removal of the toner container 51A has been started.

As described above, in the image forming apparatus 100, in a case where the release processing portion 93 releases regulation on the removal of the toner container 51A and the restriction condition is satisfied, restriction is imposed on the processing of the regulation processing portion 95 until the release condition is satisfied. With this configuration, even in a case where the amount of toner in the developing portion 23A is repeatedly decreased and increased around the second threshold due to low liquidity of the toner in the toner container 51A (see FIG. 12), the release of the regulation on the removal of the toner container 51A and the regulation on the removal of the toner container 51A are prevented from being repeated. It is therefore possible to inhibit the lock device 63A from generating a noise.

The present disclosure may be applied to an image forming apparatus that forms an image by another image forming method such as an inkjet method.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an attachment portion to which a developer storage portion storing developer is attached;

a regulation portion configured to regulate removal of the developer storage portion attached to the attachment portion from the attachment portion;

an image forming portion including a storage portion storing the developer and configured to form an image by using the developer stored in the storage portion;

a supply processing portion configured to supply the developer from the developer storage portion attached to the attachment portion to the storage portion when a storage amount of the developer stored in the storage portion is equal to or smaller than a predetermined first threshold;

a release processing portion configured to release regulation on the removal of the developer storage portion imposed by the regulation portion when the storage amount of the developer stored in the storage portion is equal to or smaller than a second threshold that is smaller than the first threshold;

a first restriction processing portion configured to impose restriction on operation of the image forming portion when the storage amount of the developer stored in the storage portion is equal to or smaller than a third threshold that is smaller than the second threshold;

a regulation processing portion configured to cause the regulation portion to regulate the removal of the developer storage portion when the storage amount of the developer stored in the storage portion is larger than the second threshold and the removal of the developer storage portion has not been regulated by the regulation portion; and a second restriction processing portion configured to impose restriction on processing of the regulation processing portion when the release processing portion releases the regulation on the removal of the developer storage portion and a predetermined restriction condition is satisfied, wherein the restriction condition includes that a number of releases performed by the release processing portion and counted during a time period from when the release processing portion starts a release to when the first restriction processing portion imposes the restriction on the operation of the image forming portion, reaches a predetermined first reference value, and an elapsed time that is a time taken for the number of releases to reach the first reference value, does not exceed a predetermined first reference time.

2. The image forming apparatus according to claim 1, wherein after imposing the restriction on the processing of the regulation processing portion, the second restriction processing portion releases the restriction on the processing of the regulation processing portion when a state where the storage amount of the developer stored in the storage portion is larger than a predetermined fourth threshold, continues for more than a predetermined second reference time, the fourth threshold being equal to or greater than the second threshold.

3. The image forming apparatus according to claim 1, further comprising:

a notification processing portion configured to notify a user that fluidity of the developer in the developer storage portion has decreased, when the second restriction processing portion imposes the restriction on the processing of the regulation processing portion.

4. The image forming apparatus according to claim 1, wherein the restriction condition includes that a remaining amount of the developer in the developer storage portion is equal to or smaller than a predetermined second reference value.

5. A regulation method that is executed in an image forming apparatus that includes an attachment portion to which a developer storage portion storing developer is attached, a regulation portion configured to regulate removal of the developer storage portion attached to the attachment portion from the attachment portion, and an image forming portion including a storage portion storing the developer and configured to form an image by using the developer stored in the storage portion, the regulation method comprising:

a supply step of supplying the developer from the developer storage portion attached to the attachment portion to the storage portion when a storage amount of the developer stored in the storage portion is equal to or smaller than a predetermined first threshold;

a release step of releasing regulation on the removal of the developer storage portion imposed by the regulation portion when the storage amount of the developer stored in the storage portion is equal to or smaller than a second threshold that is smaller than the first threshold;

a first restriction step of imposing restriction on operation of the image forming portion when the storage amount of the developer stored in the storage portion is equal to or smaller than a third threshold that is smaller than the second threshold;

a regulation step of causing the regulation portion to regulate the removal of the developer storage portion when the storage amount of the developer stored in the storage portion is larger than the second threshold and the removal of the developer storage portion has not been regulated by the regulation portion; and a second restriction step of imposing restriction on processing of the regulation step when the release step releases the regulation on the removal of the developer storage portion and a predetermined restriction condition is satisfied, wherein the restriction condition includes that a number of releases performed by the release step and counted during a time period from when the release step starts a release to when the first restriction step imposes the restriction on the operation of the image forming portion, reaches a predetermined first reference value, and an elapsed time that is a time taken for the number of releases to reach the first reference value, does not exceed a predetermined first reference time.

6. An image forming apparatus comprising:

an attachment portion to which a developer storage portion storing developer is attached;

a regulation portion configured to regulate removal of the developer storage portion attached to the attachment portion from the attachment portion;

an image forming portion including a storage portion storing the developer and configured to form an image by using the developer stored in the storage portion;

a supply processing portion configured to supply the developer from the developer storage portion attached to the attachment portion to the storage portion when a storage amount of the developer stored in the storage portion is equal to or smaller than a predetermined first threshold;

a release processing portion configured to release regulation on the removal of the developer storage portion imposed by the regulation portion when the storage amount of the developer stored in the storage portion is equal to or smaller than a second threshold that is smaller than the first threshold;

a first restriction processing portion configured to impose restriction on operation of the image forming portion when the storage amount of the developer stored in the storage portion is equal to or smaller than a third threshold that is smaller than the second threshold;

a regulation processing portion configured to cause the regulation portion to regulate the removal of the developer storage portion when the storage amount of the developer stored in the storage portion is larger than the second threshold and the removal of the developer storage portion has not been regulated by the regulation portion; and a second restriction processing portion configured to impose restriction on processing of the regulation processing portion when the release processing portion releases the regulation on the removal of the developer storage portion and a predetermined restriction condition is satisfied, wherein after imposing the restriction on the processing of the regulation processing portion, the second restriction processing portion releases the restriction on the processing of the regulation processing portion when a state where the storage amount of the developer stored in the storage portion is larger than a predetermined fourth threshold, continues for more than a predetermined second reference time, the fourth threshold being equal to or greater than the second threshold.

7. The image forming apparatus according to claim 6, wherein the restriction condition includes that a number of releases performed by the release processing portion and counted during a time period from when the release processing portion starts a release to when the first restriction processing portion imposes the restriction on the operation of the image forming portion, reaches a predetermined first reference value.

8. The image forming apparatus according to claim 6, wherein the restriction condition includes that a number of releases performed by the release processing portion and counted during a time period from when the release processing portion starts a release to when the first restriction processing portion imposes the restriction on the operation of the image forming portion, reaches a predetermined first reference value, and an elapsed time that is a time taken for the number of releases to reach the first reference value, does not exceed a predetermined first reference time.

9. The image forming apparatus according to claim 6, further comprising:

a notification processing portion configured to notify a user that fluidity of the developer in the developer storage portion has decreased, when the second restriction processing portion imposes the restriction on the processing of the regulation processing portion.

10. The image forming apparatus according to claim 6, wherein the restriction condition includes that a remaining amount of the developer in the developer storage portion is equal to or smaller than a predetermined second reference value.

* * * * *